US008698696B1

(12) United States Patent
McCandless

(10) Patent No.: US 8,698,696 B1
(45) Date of Patent: Apr. 15, 2014

(54) CORPORATE FEED NETWORK FOR COMPACT ULTRA WIDEBAND HIGH GAIN ANTENNA ARRAYS

(76) Inventor: Jay Howard McCandless, Alpine, CA (US)

( * ) Notice: Subject to any disclaimer, the term of this patent is extended or adjusted under 35 U.S.C. 154(b) by 166 days.

(21) Appl. No.: 13/373,207

(22) Filed: Nov. 7, 2011

Related U.S. Application Data

(60) Provisional application No. 61/415,881, filed on Nov. 22, 2010.

(51) Int. Cl.
*H01Q 21/00* (2006.01)

(52) U.S. Cl.
USPC ..... 343/893; 343/810

(58) Field of Classification Search
USPC ..... 343/893
See application file for complete search history.

(56) References Cited

U.S. PATENT DOCUMENTS

| | | | | |
|---|---|---|---|---|
| 3,396,398 | A * | 8/1968 | Dunlavy, Jr. | 343/814 |
| 5,534,880 | A | 7/1996 | Button et al. | |
| 6,593,892 | B2 | 7/2003 | Honda et al. | |
| 7,986,280 | B2 | 7/2011 | Semonov | |
| 2009/0195471 | A1 * | 8/2009 | Semonov | 343/810 |
| 2009/0237314 | A1 | 9/2009 | Lalezari | |

* cited by examiner

*Primary Examiner* — Jerome Jackson, Jr.
*Assistant Examiner* — Andrea Lindgren Baltzell

(57) ABSTRACT

Coaxial corporate feed technology is disclosed supporting various compact transmit or receive antenna structures to create stable high gain antenna beams over decade wide bandwidths. At its heart are axially symmetric splitters and folded coaxial arms creating a true time delay network and offering the significant advantage that the coaxial structure is closed and does not radiate or interfere with the radiating elements that it feeds. This technology will reduce the number and size of antennas needed and offers significant coverage improvements for mobile platforms and significant cost reductions on fixed platforms.

9 Claims, 9 Drawing Sheets

CORPORATE FEED NETWORK FOR COMPACT ULTRA WIDEBAND HIGH GAIN ANTENNA ARRAYS

RELATED APPLICATION INFORMATION

This application claims the priority benefit under 35 USC 119(e) of provisional application Ser. No. 61/415,881 filed Nov. 22, 2010, entitled "High Gain, Broadband Omnidirectional Antenna", by inventor Jay Howard McCandless, the disclosure of which is incorporated herein by reference in its entirety.

STATEMENT REGARDING FEDERALLY SPONSORED RESEARCH OR DEVELOPMENT

Not Applicable

REFERENCE TO A SEQUENCE LISTING, A LISTING, A TABLE OR COMPUTER PROGRAM LISTING COMPACT DISC APPENDIX

Not Applicable

BACKGROUND OF THE INVENTION

1. Field of the Invention

In general the field of endeavor to which this invention pertains is the radio communication systems and components and related methods. Specifically, it concerns antenna arrays for wireless radio communication or surveillance.

2. Description of the Prior Art and Related Background Information

Many present day and future RF and microwave systems need antennas, which are compact, high gain and cover extremely wide bands to minimize the size impact and number of antennas needed. On mobile platforms, this lowers cost, drag, and observability; on fixed platforms, such as rooftops and towers, this lowers cost, which is directly a function of real estate utilized.

Omnidirectional antennas are often required for mobile systems where the azimuth angular direction between the base station and the mobile platform is unknown, or in point-to-multipoint system base stations where uniform coverage in all directions is critical. In these systems, it is often the minimum antenna gain in azimuth that is the figure of merit, so there is a large incentive to make the gain as uniform in azimuth as possible. In addition, these systems often need the highest gain fixed on the horizon.

Sectoral antennas are often required for point-to-point systems and the highest gain possible in a fixed direction is desirable.

Prior to this invention, omnidirectional antenna solutions typically had to choose between designs that optimized gain, but only could cover a narrow band of frequencies, or optimized bandwidth, but sacrificed gain. Some have moderate gain over a large bandwidth but they are so large as to be undesirable in mobile applications. Many solutions do not have true omnidirectional uniform gain in azimuth.

A dipole antenna has omnidirectional coverage, but only 2 to 3 dB gain on the horizon. To increase the gain an array of dipole antennas stacked in elevation is needed. These are usually called collinear arrays. The issue is how to feed the stacked dipoles. If the dipoles are fed in series, then as the frequency changes, the beam scans in elevation, which can severely limit the bandwidth if there is a high gain spec on the horizon. If they are fed from the side with some from of planar corporate feed, also known as a true time delay network, then the feed interferes with the pattern in the azimuth plane and tends to make the antenna too large.

Many previous solutions have used biconical dipoles to improve bandwidth, but need to go to multi-element or stacked arrays of such dipoles to improve the gain. In this case, per the description above, due to issues with the feed network, only moderate gains or bandwidths are achieved.

Sectoral antennas are typically patch arrays, which are very compact but very narrow band or dish antennas, which are moderately compact and medium bandwidth, or horn antennas, which can be extremely broadband, but also are extremely bulky.

BRIEF SUMMARY OF THE INVENTION

The present invention solves all of the above problems by making a coaxial corporate feed with all the arms of the feed having a common axis [collinear], that goes down the center of the stacked array of radiating elements in the case of an omnidirectional antenna, or feeds an array of stacked flared apertures in the case of sectoral antenna. Because the feed is a true time delay network, the antenna pattern does not scan in elevation with frequency. With this solution, the main beam always points in a fixed direction over multiple bands covering greater than decade wide bandwidths making it extremely broadband.

This invention, embodied as a four-way corporate feed network, which is shown in FIG. 1, supports an antenna that typically would be mounted on a large flat metallic surface to form a ground plane, such as the top of a vehicle, or alternately to the top of a mast. The ground plane or mast (not shown) would attach at the bottom of the antenna surface [15]. FIG. 2 shows a cross sectional view of FIG. 1. The coax input/output [30] in FIG. 2, would pass through the ground plane or mast and connect to radio electronics. The antenna could be used for either transmit or receive.

A huge advantage to this type of feed is that the coaxial structure is closed and does not radiate or interfere with the radiating elements that it feeds.

Four way and eight way corporate feed networks have been designed with 100 to 1 bandwidths, and could be easily extended to even greater bandwidths. The antenna bandwidth is only limited by the return loss bandwidth of the radiating element. For omnidirectional antennas, flared slots can be used to give 20 to 1 bandwidths, stepped slots for 2 to 1 bandwidths and resonant coaxial dipoles for 25% bandwidths. Because the feed and radiating elements are typically symmetric around the axis, the antenna patterns are perfectly uniform in azimuth. For sectoral antennas, flared balanced line radiating elements can be used for 10:1 or greater bandwidth. Also notable and important: this corporate feed network is scalable: as many radiating elements as desired can be stacked on top of one another increasing the gain substantially above the gain achievable with previous broadband techniques.

This is revolutionary coaxial coax corporate feed technology. This is the first corporate feed technology supporting various antenna structures to create stable high gain antenna beams over decade wide bandwidths. At its heart are axially symmetric splitters and folded coaxial arms creating a true time delay network. The feed or antenna can easily be assembled by sliding the pieces together along the axis.

DETAILED DESCRIPTION OF THE INVENTION

At the heart of the invention is an axially symmetric coaxial [collinear] coax corporate feed or splitter. For ease of understanding in this disclosure, the feed will be described from the perspective of a transmitter, but it is to be understood that it works equally well as a receiver.

The corporate feed uses coaxial transmission lines. As those skilled in the art know, the signals in coaxial transmission lines travel in the TEM mode. This allows the feed to work from very low frequencies (in fact down to DC) up to frequencies for which the coaxial line becomes difficult to manufacture—but at least 100 GHz. In the ensuing description, it is shown and assumed that the coaxial transmission line is axially symmetric and is composed of concentric cylinders. However, this is not a necessary condition and other cross sections will work as well, including but not limited to, square and elliptical.

Figure 1:
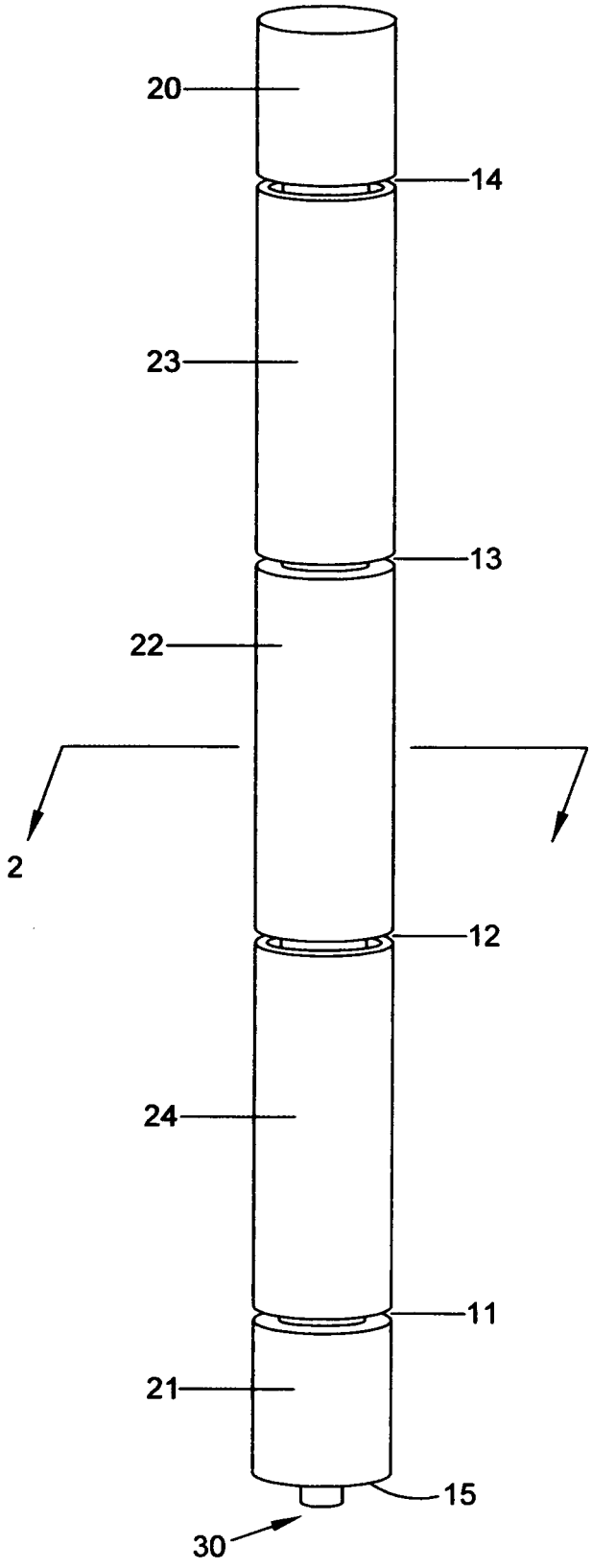
FIG. 1—is a perspective view of a specific example of a four way corporate feed network showing the four annular slots: [11], [12], [13] and [14] that would be the inputs/outputs from a four way corporate feed and the five conducting parts: [20], [21], [22], [23] and [24]
Figure 2:
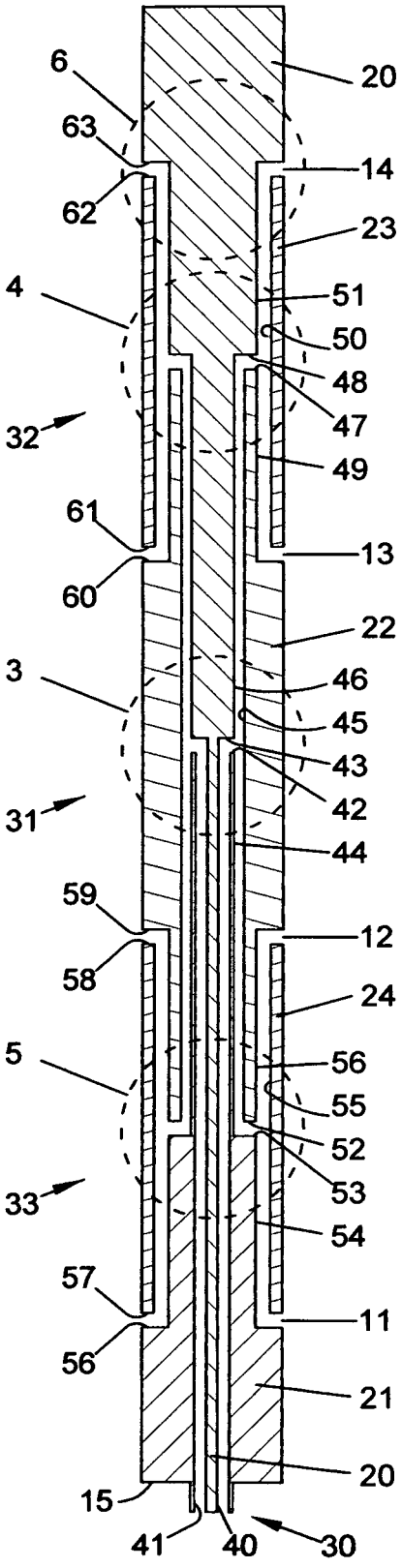
FIG. 2—shows a cross sectional view of FIG. 1.

The output of the feed is annular slots with uniform field distributions around each slot and with all output slots in phase with each other. We will use a four way corporate feed as a specific example for this disclosure. It is to be understood by anyone experienced in the field that the invention is equally valid for an N-way corporate feed network, where N is any integer greater than 1. FIG. 1 shows the four annular slots: [11], [12], [13] and [14] that would be the outputs from a four way corporate feed. FIG. 2 shows a cross-sectional view of the four way feed shown in FIG. 1. This feed consists of five axially symmetric conducting parts [20], [21], [22], [23], and [24]. In this specific example of the disclosure it is also to be understood by someone skilled in the arts that all parts are typically held in place with dielectric supports of some sort—often a plastic such as Teflon. But since air is a valid dielectric, for ease of viewing and understanding, in this disclosure, air is assumed as the dielectric.

The five axially symmetric conducting parts [20-24] create the five functional blocks of the corporate feed network (in transmit mode): 1) a coaxial input [30]; 2) a first splitter [31]; 3) an upper second level splitter [32]; 4) a lower second level splitter [33] and 5) four annular slot outputs [11], [12], [13,] and [14].

The coaxial input consists of the signal carried between the outer cylindrical surface [40] of the inner conductor [20] and the inner cylindrical surface [41] of the outer conductor [21].

Figure 3:
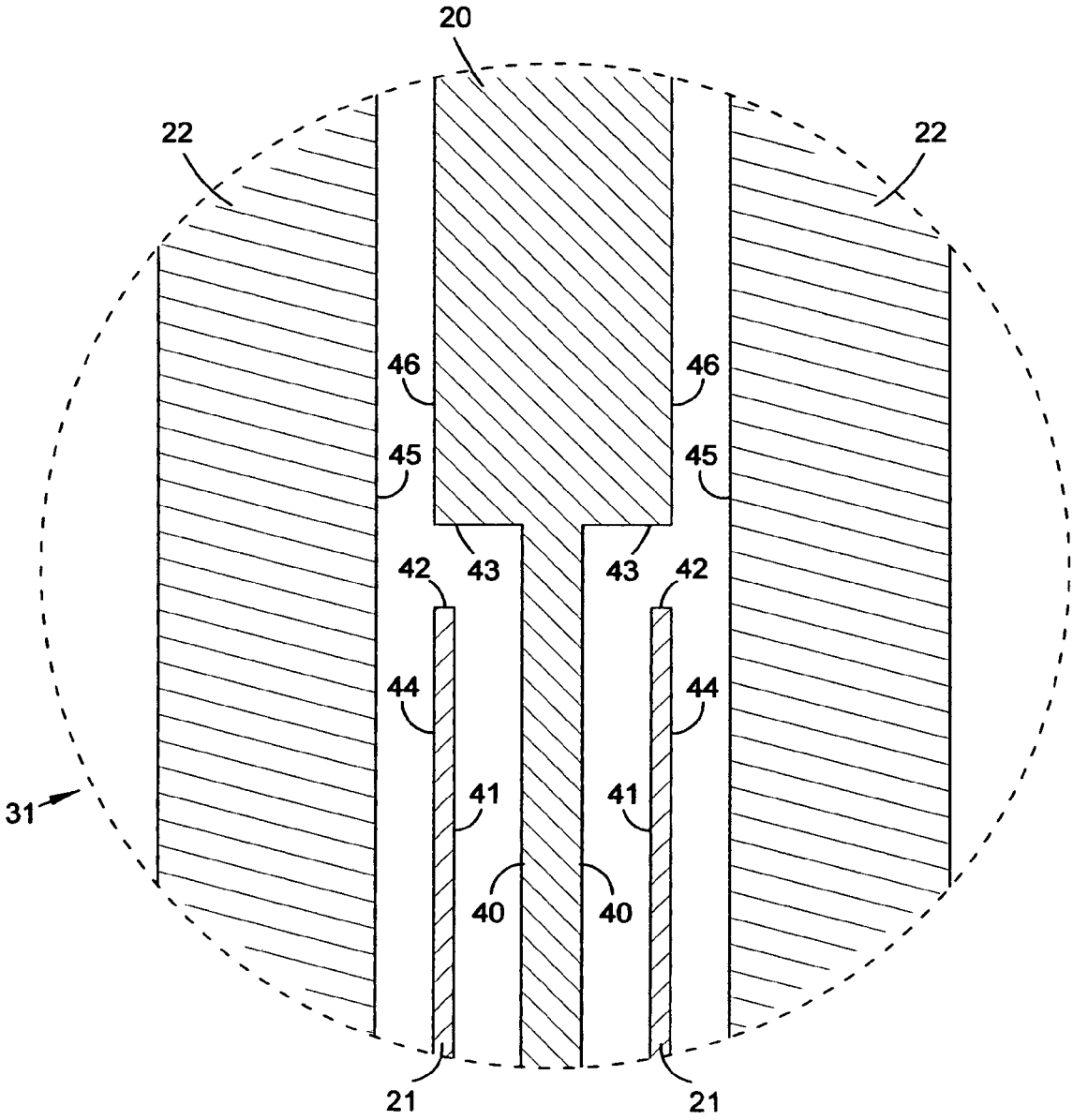
FIG. 3—shows an expanded cross sectional view of the first level splitter [31].

FIG. 3 shows an expanded view of the first level splitter [31]. The first level splitter is fed by the signal from the coaxial input between cylindrical surfaces [40] and [41]. The signal is bent 90 degrees to travel radially outward between surfaces [42] and [43] and then is split with half the signal travelling coaxially down between the cylindrical surface [44] of conducting part [21] and cylindrical surface [45] of conducting part [22], and half travelling coaxially upward between cylindrical surface [46] of conducting part [20] and cylindrical surface [45] of conducting part [22].

Figure 4:
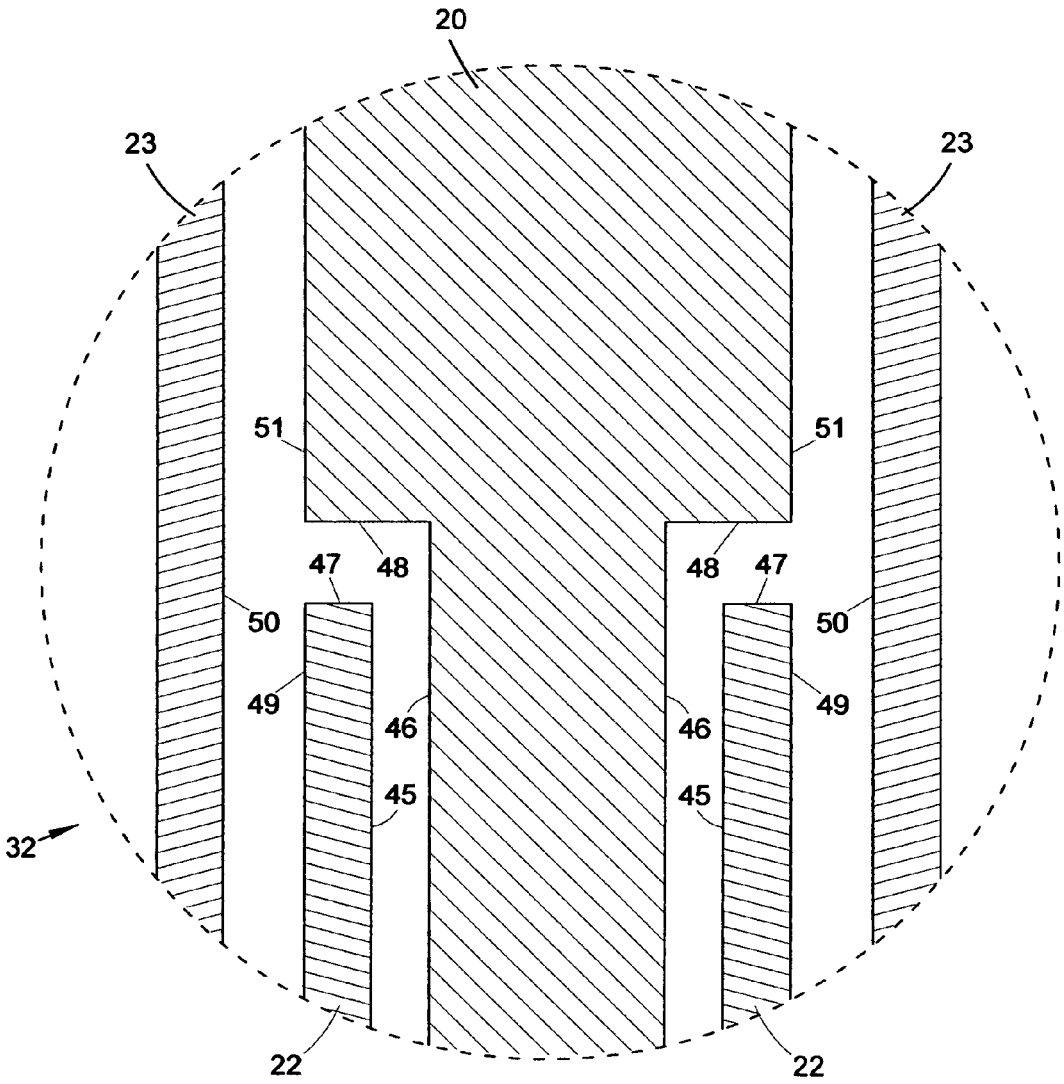
FIG. 4—shows an expanded cross sectional view of the upper second level splitter [32].

FIG. 4 shows an expanded cross sectional view of the upper second level splitter [32] of FIG. 2. The upper second level splitter [32] is fed by the coaxial signal carried between cylindrical surfaces [45] and [46]. Again the coaxial signal is bent 90 degrees to travel outward radially between surfaces [47] of conducting part [22] and [48] of conducting part [20], and then is split with half the signal travelling coaxially down between cylindrical surface [49] of conducting part [22] and cylindrical surface [50] of conducting part [23] and half travelling coaxially upward between cylindrical surface [51] of conducting part [20] and cylindrical surface [50] of conducting part [23].

Figure 5:
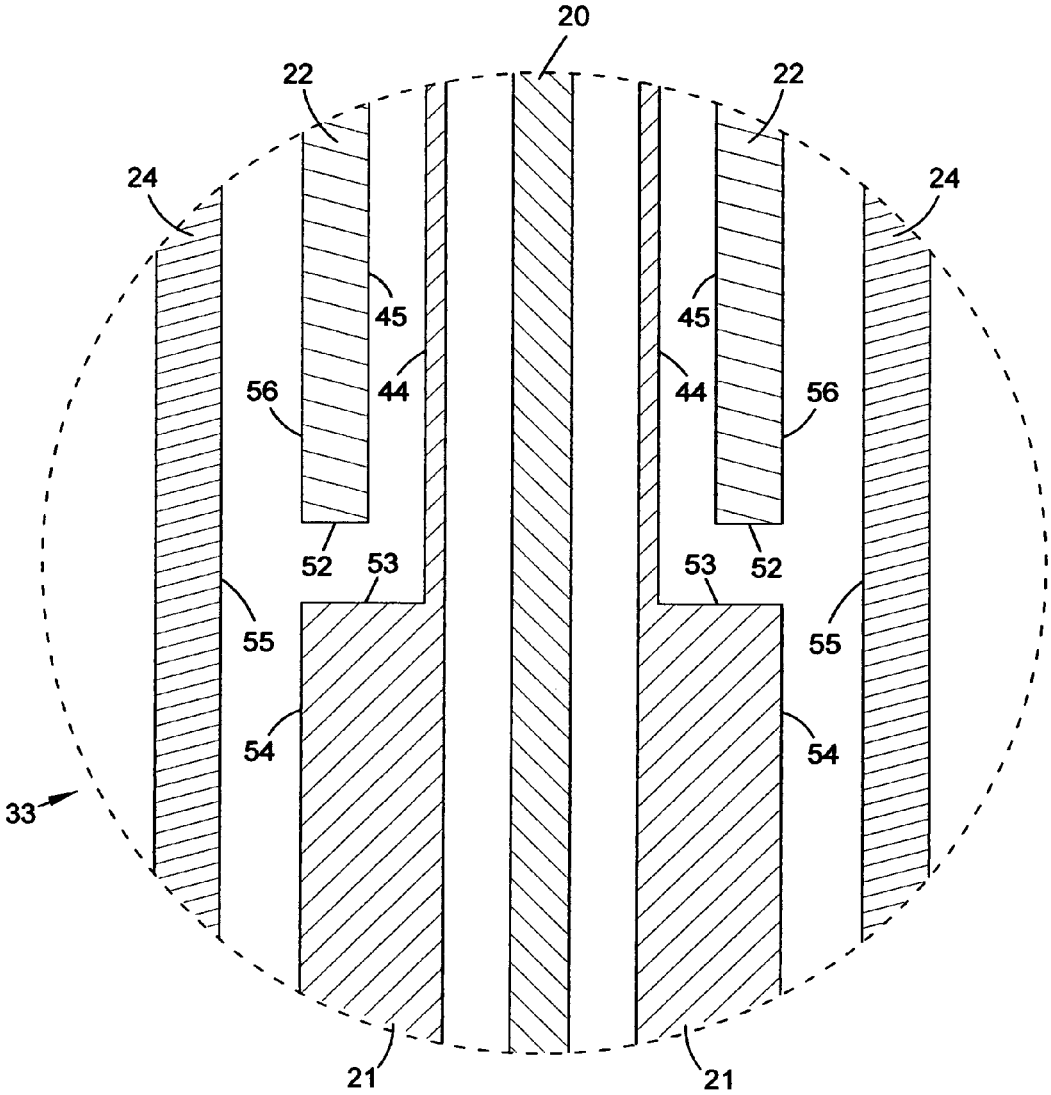
FIG. 5—shows an expanded cross sectional view of the lower second level splitter [33].

FIG. 5 shows an expanded cross sectional view of the lower second level splitter [33] of FIG. 2. The lower second level splitter [33] is fed by the coaxial signal traveling downward between cylindrical surface [44] of conducting part [21] and cylindrical surface [45] of conducting part [22]. Again the coaxial signal is bent 90 degrees to travel outward radially between surfaces [52] of conducting part [22] and [53] of conducting part [21] and then is split with half the signal travelling coaxially down between cylindrical surface [54] of conducting part [21] and cylindrical surface [55] of conducting part [24] and half travelling coaxially upward between cylindrical surface [56] of conducting part [22] and cylindrical surface [55] of conducting part [24].

Figure 6:
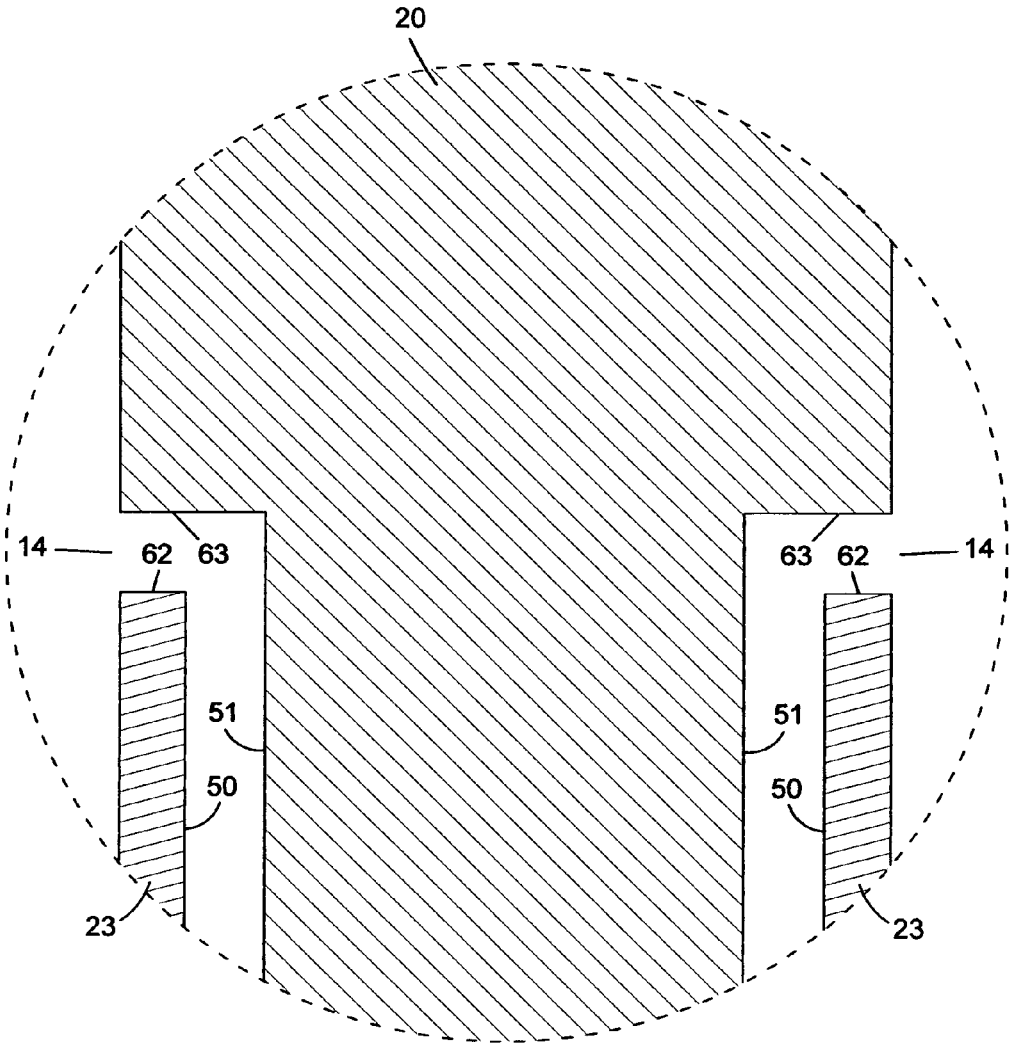
FIG. 6—shows an expanded cross sectional view of the upper annular slot [14].

FIG. 6 shows a cross sectional view of annular slot [14] and its coaxial feed. The other annular slots and their feeds operate on the same principal and are not shown in expanded view.

Annular slot [14] is fed by the coaxial signal traveling upward between cylindrical surfaces [51] on conducting part [20] and cylindrical surface [50] on conducting part [23]. The signal is bent 90 degrees to travel outward radially between parallel surfaces [62] on conducting part [23] and [63] on conducting part [20].

Annular slot [13] is fed by the coaxial signal traveling downward between cylindrical surface [49] on conducting part [22] and cylindrical surface [50] on conducting part [23]. The signal is bent 90 degrees to travel outward radially between parallel surfaces [60] on conducting part [22] and [61] on conducting part [23].

Annular slot [12] is fed by the coaxial signal traveling upward between cylindrical surfaces [56] on conducting part [22] and cylindrical surface [55] on conducting part [24]. The signal is bent 90 degrees to travel outward radially between parallel surfaces [58] on conducting part [24] and [59] on conducting part [22].

Annular slot [11] is fed by the coaxial signal traveling downward between cylindrical surface [54] on conducting part [21] and cylindrical surface [55] on conducting part [24]. The signal is bent 90 degrees to travel outward radially between parallel surfaces [56] on conducting part [21] and [57] on conducting part [24].

Although not specifically spelled out here, signals in coaxial transmission lines, such as the coaxial transmission line defined by cylindrical surfaces [40] and [41], have a relationship between the voltage and the current known as impedance. Impedance is a function of the ratio of the two cylindrical diameters and the electromagnetic properties of the dielectric material in the gap between the two cylinders. As anyone skilled in the electromagnetic arts would know, for very broadband operation one of the requirements is that at each level of splitting for a coaxial splitter, such as used here, the two output arms must each have an impedance of ½ the input coax's impedance.

The four annular slots [11], [12], [13], and [14] are ready to feed a stacked array comprised of four antenna elements. The antenna elements can consist of any balanced antenna structure such as radially symmetric elements for omnidirectional performance, or such as a flared slot or cylindrical dipole, or such as balanced transmission lines for feeds to sector antenna array elements.

Figure 7:
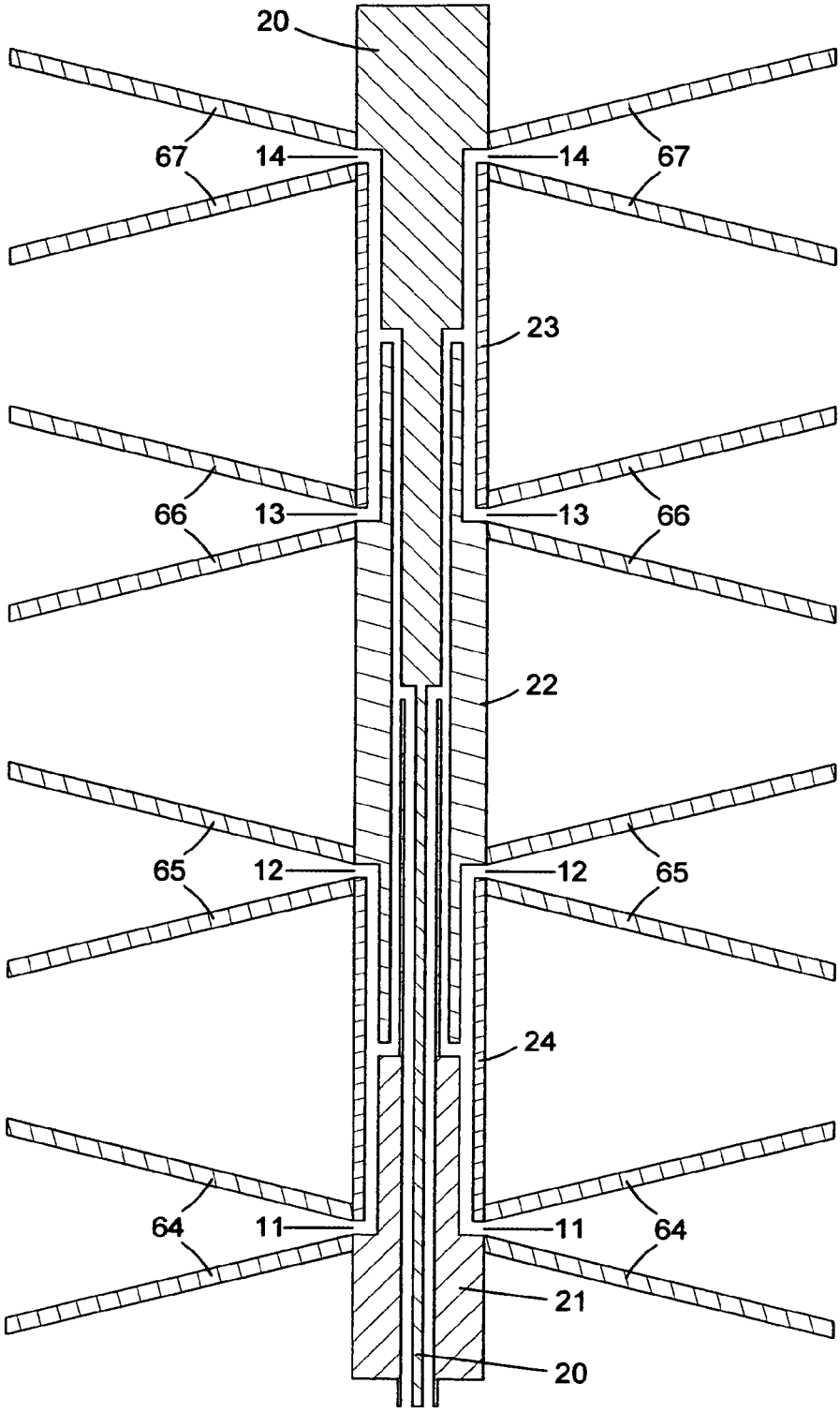
FIG. 7—shows an expanded cross sectional view of the feed network from FIG. 2 being used to feed four flared annular slot antenna elements.

FIG. 7 shows a cross sectional view of a specific example of the four annular slots [11], [12], [13], and [14] feeding flared annular slots [64], [65], [66], and [67].

Figure 8:
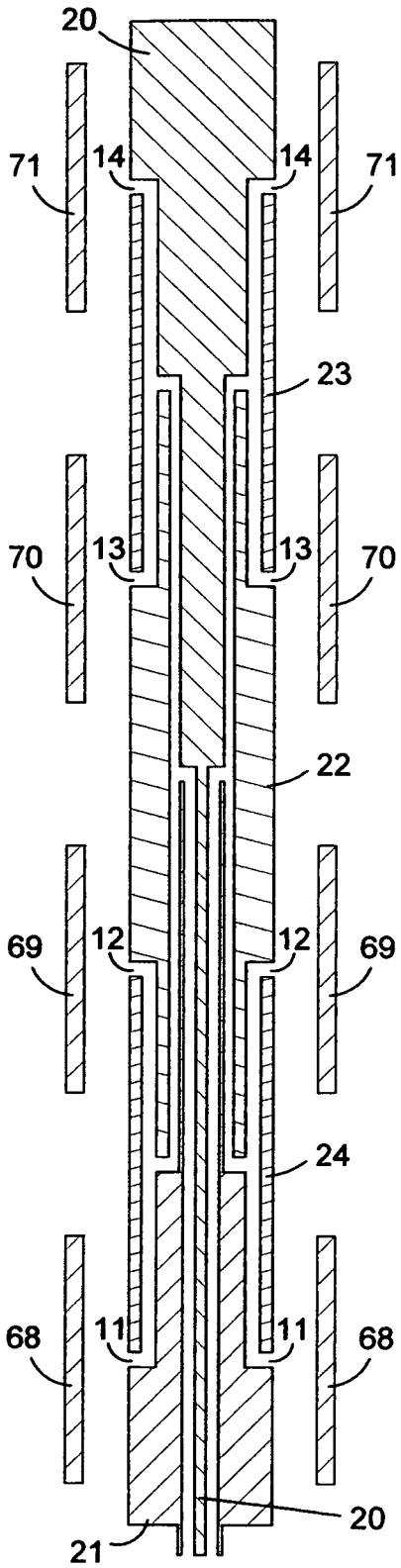
FIG. 8—shows an expanded cross sectional view of the feed network from FIG. 2 being used to feed four coaxial dipoles.

FIG. 8 shows a cross sectional view of a specific example of the four annular slots [11], [12], [13], and [14] feeding coaxial dipoles [68], [69], [70], and [71].

Figure 9:
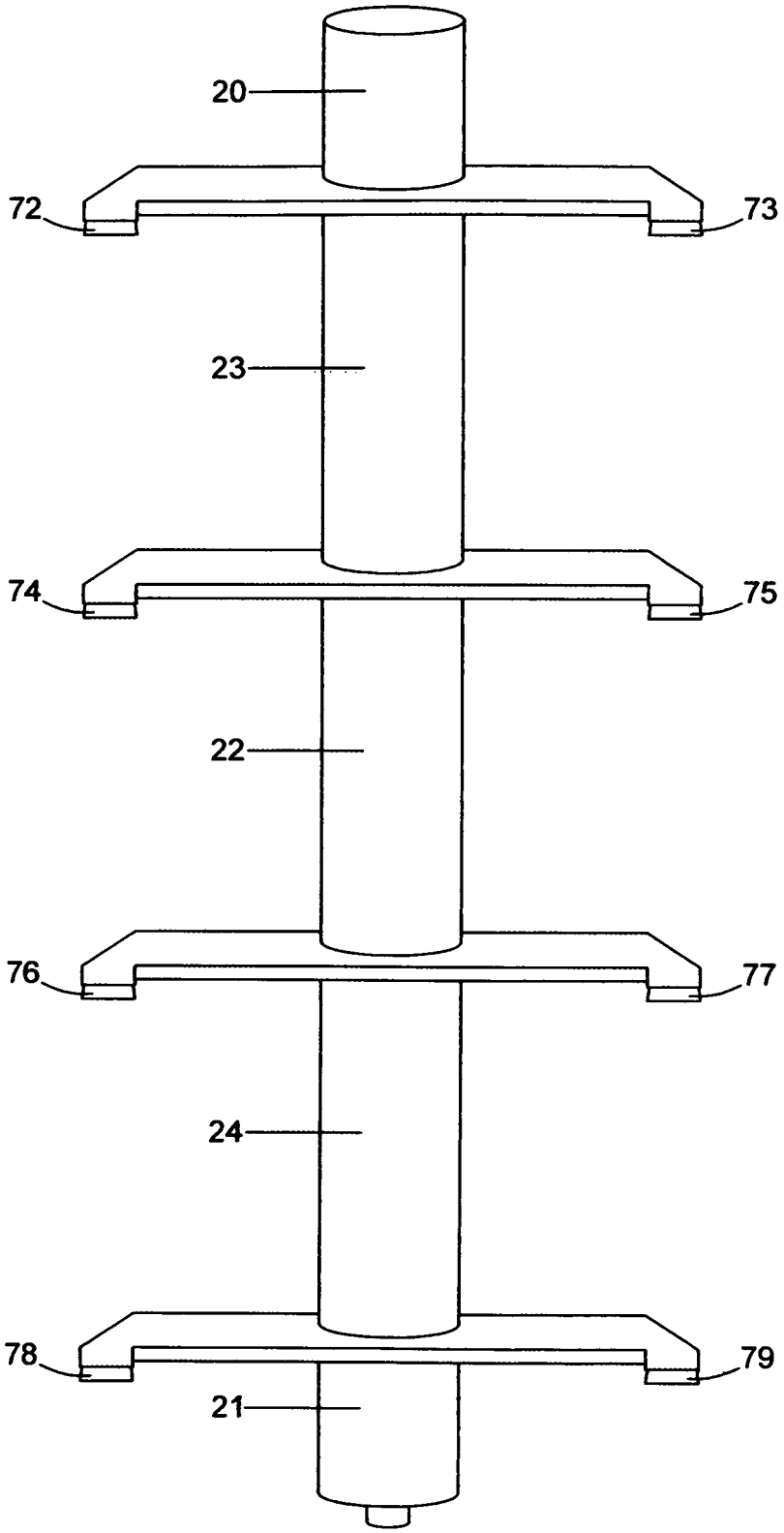
FIG. 9—shows an expanded cross sectional view of the feed network from FIG. 2 being used to feed eight balanced transmission lines.

FIG. 9 shows a perspective view of a specific example of the four annular slots [11], [12], [13], and [14] from FIG. 1 feeding balanced transmission lines [72], [73], [74], [75], [76], [77], [78], and [79] which would then feed eight flared sectoral antenna elements.

Fabrication and Assembly:

The antenna parts fabrication and assembly is straightforward. Parts [20], [21], [22], [23] and [24] from FIG. 1 slide together along the main axis with dielectric spacers for support and proper impedance. These parts could be machined from any conducting material, such as aluminum, on a CNC lathe; all the dielectric material (i.e. Teflon) supports and spacers would also be machined on a CNC lathe. Depending on the frequency band of interest and production volume, the metal parts could be die cast and the dielectric parts could be injection molded. Typically, a cylindrical radome with a cap would cover the outside for environmental protection and additional support.

If desired, the corporate feed network could easily be designed to work from 40 MHz to 40 GHz, a 1000 to 1 bandwidth. The corporate feed network is easiest to design if it splits uniformly and by factors of 2, but it can be designed for odd splits and non-uniform splits for electronic field tapers across the antenna elements. The feed's splitters can even be designed with a specific frequency response, such that the outer elements are not used at higher frequencies to keep the gain constant with frequency. The signal can be split as many times as desired by adding coaxial layers and is only limited by the maximum allowed diameter for each situation.

A version of the antenna with flared annular slots and a four way corporate feed, covering 500 MHz to 20 GHz was designed and built. The measured results showed a VSWR of better than 3 to 1 at the coaxial input [30] from FIG. 1 and a gain of 0 dB to 14 dB over the designed band.

What is claimed is:

1. A cylindrical co-axial coax corporate feed network with axially symmetrical concentric co-axial conducting surfaces, comprising:

coax transmission line inputs/outputs, and cylindrical co-axial splitters/combiners, and annular slot output/inputs, wherein a) the coax transmission line inputs/outputs are between two co-axial concentric conducting surfaces with a dielectric material between the concentric conducting surfaces for appropriate impedance and support, and b) the cylindrical co-axial splitters/combiners are connected with coax transmission lines where all coax transmission lines and splitters/combiners have a common axis, such that each splitter/combiner is composed of a coax transmission line input/output that is bent radially to travel outward/inward and then is split or combined into or from two coax transmission lines, which are folded back on top of the coax transmission line input/output, one upward and one downward with the same axis, wherein the upward and downward coax transmission line input/outputs are then used to feed a next level of splitter/combiner or to a plurality of annular slot outputs/inputs until N annular slots, where N is an integer greater than 1, are achieved; and upward and downward traveling transmission lines, using the outer conductor of one coax transmission line input/output as an inner conductor and then add an additional cylindrical concentric co-axial conductor as an outer conductor.

2. The co-axial coax corporate feed network of claim 1 wherein the coax transmission lines have a non-circular cross section such as square or elliptical, but are still comprised of concentric conducting surfaces.

3. The co-axial corporate feed network of claim 1 or claim 2 wherein the splitters/combiners split or combine non-equally in power and/or wherein the splitters/combiners change the split or combining ratio as a function of frequency and/or wherein the coax transmission lines between splitters/combiners have unequal lengths.

4. The co-axial corporate feed network of claim 1 further connected to and feeding a radiating element.

5. The co-axial coax corporate feed network of claim 2 further connected to and feeding a radiating element.

6. The co-axial coax corporate feed network of claim 3 further connected to and feeding a radiating element.

7. An antenna array system comprising the corporate feed system of claim 1 including and feeding a plurality of radiating elements.

8. An antenna array system comprising the corporate feed system of claim 2 including and feeding a plurality of radiating elements.

9. An antenna array system comprising the corporate feed system of claim 3 including and feeding a plurality of radiating elements.

* * * * *